United States Patent [19]

Sando et al.

[11] 4,304,109

[45] Dec. 8, 1981

[54] APPARATUS FOR FIXING DYES PRINTED ON A CLOTH BY WET HEAT TREATMENT

[75] Inventors: Yusikazu Sando; Hiroshi Ishidoshiro, both of Wakayama, Japan

[73] Assignee: Sando Iron Works, Co. Ltd., Wakayama, Japan

[21] Appl. No.: 42,851

[22] Filed: May 29, 1979

[30] Foreign Application Priority Data

Jun. 2, 1978 [JP] Japan ..... 53-75406[U]

[51] Int. Cl.[3] ..... D06B 3/12; D06B 3/22

[52] U.S. Cl. ..... 68/5 E

[58] Field of Search ..... 68/5 D, 5 E; 34/157

[56] References Cited

U.S. PATENT DOCUMENTS 694,640 3/1902 Hebden ..... 68/5 D 3,326,022 6/1967 Drago ..... 68/5 D

FOREIGN PATENT DOCUMENTS 479804 12/1951 Canada ..... 68/5 D 211479 12/1940 Switzerland ..... 34/157

977560 12/1964 United Kingdom ..... 68/5 D

*Primary Examiner*—Philip R. Coe

*Attorney, Agent, or Firm*—Toren, McGeady and Stanger

[57] ABSTRACT

An apparatus using wet heat treatment for fixing dyes printed on a cloth including a plurality of horizontal cloth hanging rolls disposed in generally parallel relation and spaced apart at equal and narrow intervals in the upper part of a high pressure steamer for transporting the cloth continuously through the high pressure steamer by hanging the cloth on the rolls and forming loops in the gaps between them. A horizontally arranged cloth supporting device is located below and in parallel relation with the cloth hanging rolls at a location immediately above the water level of a body of hot water provided in the bottom of the steamer. The cloth supporting device supports and transports the lower ends of the loops of cloth. The cloth supporting device can be formed by a plurality of cloth supporting rolls closely spaced apart or an endless net conveyer.

3 Claims, 1 Drawing Figure

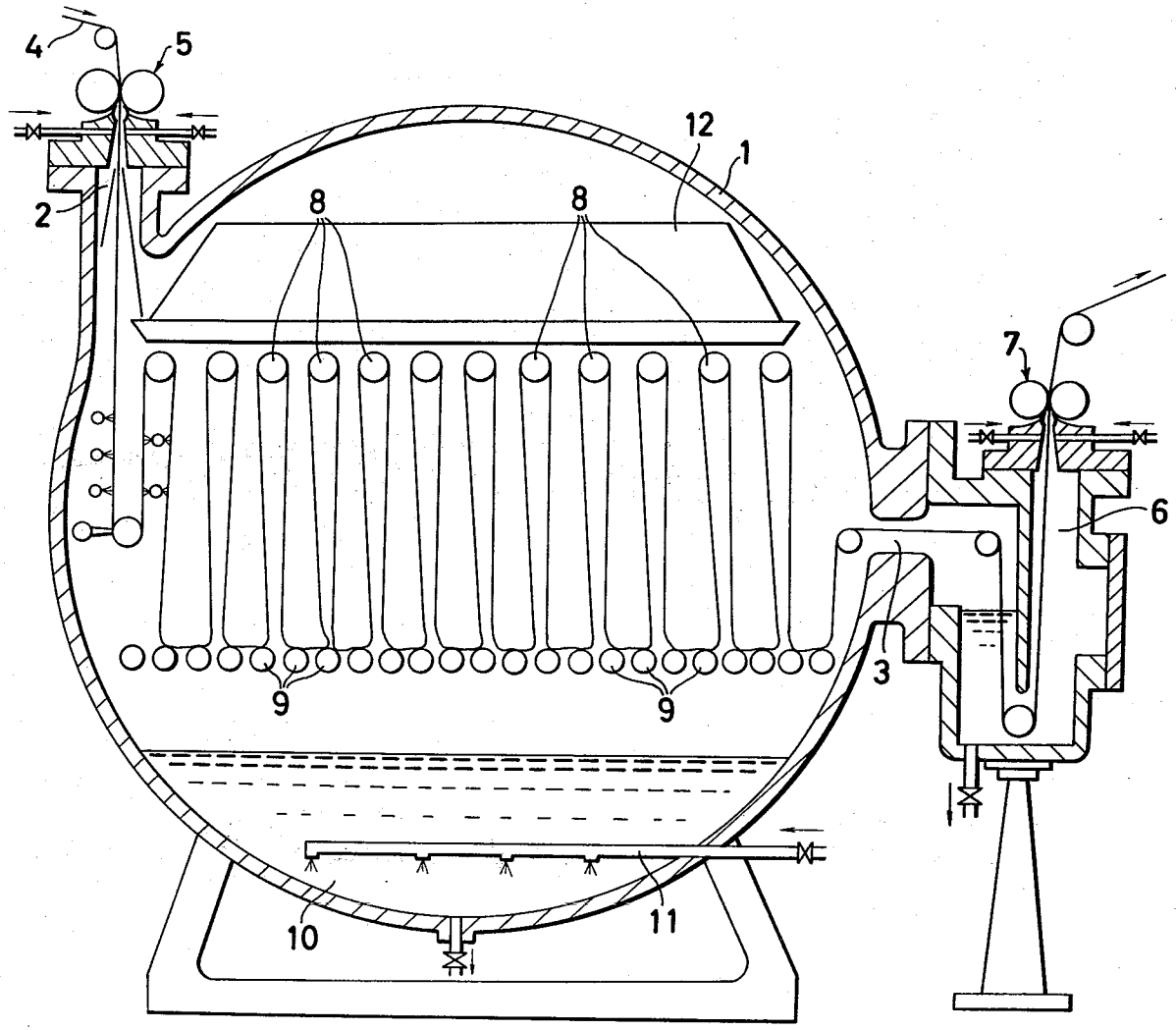
1
2
3
4
5
6
7
8
8
9
9
10
11
12

APPARATUS FOR FIXING DYES PRINTED ON A CLOTH BY WET HEAT TREATMENT

The present invention relates to an apparatus for fixing dyes printed on a cloth in wet heat treatment comprising transporting a printed cloth through a high pressure steamer.

As a means for fixing and color-developing dyes (including pigments) printed on a cloth to form prescribed patterns, it has hitherto been proposed to fix the dyes in a high temperature wet atmosphere by continuously transporting the printed cloth through a high pressure steamer. A high pressure steamer is well known in which a plurality of guide rolls are provided so as to transport a cloth along a zigzag path for the purpose of prolonging the dwell period of the cloth in a high temperature wet atmosphere. In the case of a printed cloth, however, since both sides of the cloth contact alternately the guide rolls in guiding the cloth through such a high pressure steamer, troubles occur such that the printed surface is stained and the patterns lose their clearness.

To avoid such a drawback, it has been proposed to transport a cloth held on a plurality of guide rolls in a hanging state forming loops through a high pressure steamer, thus eliminating the contact between the printed surface and the guide rolls, but it is difficult to hold a cloth stably in a hanging state forming loops in a sealed high pressure steamer body. Namely, while it is easy at the earlier stage of the operation to hold a cloth in a hanging state forming loops on a plurality of guide rolls provided at equal intervals in a high pressure steamer, there occur during the operation frequently such troubles that the cloth slips from the guide rolls or the cloth is rolled on the guide rolls, and consequently the balance is lost among the hanging loops rendering continuous operation impossible.

Against such a background, the present invention offers an excellent apparatus for fixing dyes printed on a cloth by wet heat treatment comprising providing a plurality of cloth hanging rolls horizontally in one direction at equal and narrow intervals in the upper part of a high pressure steamer for transporting a cloth continuously through the high pressure steamer by hanging the cloth on the rolls and forming loops in the gaps between them, and a horizontal cloth supporting device just under the cloth hanging rolls and in parallel thereto at a position immediately above the water level of a body of hot water provided in the bottom of the steamer to support and transport the lower loop ends of the cloth.

The invention will be explained in detail according to the example shown in the drawing.

The drawing is a sectional side view of an example of the present inventive apparatus for fixing dyes printed on a cloth by wet heat treatment. In the drawing, (1) is a steamer body, (2) is a cloth inlet opening, (3) is a cloth outlet opening, (4) is a cloth, (5) is an inlet-side sealing device, (6) is a slowly cooling tank, (7) is an outlet-side sealing device, (8) are hanging rolls to hang the cloth forming loops, (9) are supporting rolls for the cloth, (10) is a hot water tank, (11) is a steam blowing-in pipe and (12) is a water-drop preventing plate.

The high pressure steamer body (1) is to hold a high pressure steam at temperatures higher than 100° C., for instance, about 160° C. The steamer body (1) is provided with cloth inlet opening (2) for continuously supplying the cloth into the steamer body, and with cloth outlet opening (3) for continuously removing the cloth from the steamer body. The cloth inlet opening and the cloth outlet opening are provided, respectively, with the inlet-side sealing device (5) and the outlet-side sealing device (7) for continuously transporting the cloth through the steamer body by maintaining the high temperature and high pressure steam in the steamer body without any leakage. As for the sealing devices, various disclosures have been published by the present applicants, but their details will be abridged because the sealing device for a high pressure steamer is not within the scope of the present invention.

In the upper part of the steamer body (1), a plurality of horizontal cloth hanging rolls (8) are provided extending in one direction at equal and narrow intervals for hanging the cloth and forming loops in the gaps between them. Preferably the surface of the cloth hanging rolls has a large friction coefficient for prevent slippage between the cloth and the rolls. The cloth hanging rolls are rotated at a constant speed by a driving means (not shown in the drawing) to transport the cloth continuously. At the lower part of the steamer body, a plurality of horizontal cloth supporting rolls (9) are provided just under the cloth hanging rolls in parallel thereto and spaced apart at close intervals to support and transport the lower loop ends of the cloth. The cloth supporting rolls are rotated slowly in the transferring direction of the cloth by means of a driving means (not shown in the figure). Beneath the cloth supporting rolls in the bottom of the steamer body, a hot body of water tank (10) is provided to elevate the temperature and humidity of the atmosphere in the steamer body. The body hot water tank is provided with a steam blowing-in pipe (11). A water drop preventing plate (12) is provided above the group of cloth hanging rolls (8) to prevent the exposure of the cloth to water drops falling from the ceiling of the steamer body.

The process of treating a printed cloth in the present invention by using the above-mentioned apparatus is as follows.

At first, one end portion of a long printed cloth to be treated (4) is hung successively on a plurality of cloth hanging rolls (8) provided at the upper part of the steamer body (1) forming loops in the gaps between them so that the loop ends of the cloth just touch the cloth supporting rolls (9) provided in the lower part of the steamer body as shown in the drawing. In this operation, a guide cloth (not shown in the drawing), whose end is connected to the printed cloth, may conveniently be applied.

The steamer is then closed, and brought to a condition filled with a high temperature and high pressure steam at about 160° C. In rotating the cloth hanging rolls (8) and the cloth supporting rolls (9) respectively at prescribed speeds, the cloth is transported successively through the steamer while maintaining the loopy state with a definite length. In the meantime, the dyes printed on the cloth is fixed in a short period sufficiently by the effect of the wet heat in the steamer.

The most characteristic feature of the present invention is that, since the cloth supporting rolls (9) are provided at close intervals just under the cloth hanging rolls (8), the loop ends of the cloth are transported smoothly in contact with the cloth supporting rolls due to the driving force of the cloth supporting rolls. Even when the cloth is accumulated to some extent on the cloth supporting rolls, the operation goes smoothly, and simultaneously there is no danger that the cloth is immersed in the hot water tank provided in the bottom of the steamer. Thus, the transportation and the wet heat treatment of a printed cloth can be done with a high reliability. Moreover, since only one side of the cloth touches with the cloth hanging rolls (8) and the cloth supporting rolls (9) in the steamer, there is no problem that the printed surface is stained and the print becomes indistinct so long as the printing is done on the other surface of the cloth.

Although the cloth supporting device comprises a plurality of supporting rolls provided at close intervals in the above-mentioned example, an endless net conveyer transferable freely in the direction of transporting the cloth can similarly be employed.

What is claimed is:

1. An apparatus using wet heat treatment for fixing dyes printed on at least one side of a cloth comprising a high pressure steamer defining a vertically extending chamber, a body of hot water located in the bottom of said chamber and having a water level spaced upwardly from the bottom of said steamer, said steamer having an inlet into and an outlet from said chamber, a plurality of driven cloth hanging rolls located in the upper part of said chamber spaced upwardly from said water level located in the bottom thereof, said cloth hanging rolls extending horizontally in said chamber and disposed in closely spaced parallel relation forming narrow gaps therebetween, means for supporting the cloth to be treated located in the lower part of said chamber spaced below said cloth hanging rolls and closely above said water level, said means being driven, said cloth hanging rolls arranged to dependently support the cloth so that the cloth runs over and hangs downwardly in a loop between each pair of adjacent said cloth hanging rolls and the lower end of each loop contacts and is supported by said cloth supporting means with the loop of cloth extending upwardly from the lower end thereof to the next cloth hanging roll so that the lower end of the loop contacts said cloth supporting means in a smooth unfolded state and between said cloth hanging rolls and said cloth supporting means the cloth in each loop hangs in a rectilinear form spaced from the adjacent loops, said cloth hanging rolls and cloth supporting means being arranged so that only one side of the cloth contacts said cloth hanging rolls and cloth supporting means with the other side of the cloth remaining out of contact with said cloth hanging rolls and cloth supporting means and other portions of the cloth itself whereby dyes printed on the other side are not stained and do not become indistinct.

2. An apparatus, as set forth in claim 1, wherein said cloth supporting means comprises a plurality of horizontally arranged cloth supporting rolls disposed in parallel relation with one another and in parallel relation with said cloth hanging rolls, said cloth supporting rolls disposed in closely spaced relation and positioned below said cloth hanging rolls so that said cloth supporting rolls are approximately aligned with the downwardly extending parts of the loops of the cloth formed between each adjacent pair of said cloth hanging rolls.

3. An apparatus, as set forth in claim 2, wherein two said cloth supporting rolls are located below each said cloth hanging roll.

* * * * *